US009493173B2

(12) United States Patent
Hirashima et al.

(10) Patent No.: US 9,493,173 B2
(45) Date of Patent: Nov. 15, 2016

(54) RAILCAR

(71) Applicant: KAWASAKI JUKOGYO KABUSHIKI KAISHA, Kobe-shi, Hyogo (JP)

(72) Inventors: Toshiyuki Hirashima, Kobe (JP); Shirou Honma, Kobe (JP); Hitoshi Nagahara, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 14/440,633

(22) PCT Filed: Oct. 17, 2013

(86) PCT No.: PCT/JP2013/006173

§ 371 (c)(1),
(2) Date: May 5, 2015

(87) PCT Pub. No.: WO2014/068885

PCT Pub. Date: May 8, 2014

(65) Prior Publication Data

US 2015/0298712 A1 Oct. 22, 2015

(30) Foreign Application Priority Data

Nov. 5, 2012 (JP) ..... 2012-243390

(51) Int. Cl.
*B61F 1/00* (2006.01)
*B61F 1/08* (2006.01)
(Continued)

(52) U.S. Cl.
CPC ..... *B61F 1/08* (2013.01); *B61D 15/06* (2013.01); *B61F 1/10* (2013.01)

(58) Field of Classification Search
CPC ..... B61F 1/08; B61F 19/04; B61F 1/10; B61G 7/10; B61G 11/16; B61D 15/06
USPC ..... 105/392.5, 296; 213/220–222
See application file for complete search history.

(56) References Cited

U.S. PATENT DOCUMENTS 3,968,862 A * 7/1976 Gorges ..... B60R 19/32 188/268
5,462,144 A * 10/1995 Guardiola ..... B61F 1/08 105/416

(Continued)

FOREIGN PATENT DOCUMENTS

JP 2009-001178 A 1/2009
JP 2011-235728 A 11/2011

(Continued)

OTHER PUBLICATIONS

Jan. 21, 2014 International Search Report issued in International Application No. PCT/JP2013/006173.

*Primary Examiner* — Jason C Smith
(74) *Attorney, Agent, or Firm* — Oliff PLC

(57) ABSTRACT

A railcar includes an underframe and an energy absorber provided at the underframe. The underframe includes a first end beam, a second end beam, and a sliding center sill connecting the first end beam and the second end beam with each other. The sliding center sill includes a first beam member connected to the first end beam, a second beam member connected to the second end beam, and a coupling member coupling the first beam member to the second beam member. The first beam member slides relative to the second beam member when the coupling member breaks by application of an impact load higher than a predetermined load. The sliding center sill and the energy absorber are arranged in a region located between the first end beam and the second end beam.

8 Claims, 8 Drawing Sheets

(51) Int. Cl.
*B61D 15/06* (2006.01)
*B61F 1/10* (2006.01)

(56) References Cited

U.S. PATENT DOCUMENTS 5,579,699 A * 12/1996 Dannawi ..... B60R 19/18 105/416
6,393,999 B1 * 5/2002 Schneider ..... F16F 7/123 104/254
2007/0125739 A1 * 6/2007 Hogbring ..... B61G 7/10 213/75 R
2007/0175851 A1 * 8/2007 Hogbring ..... B60D 1/50 213/62 R
2007/0186802 A1 * 8/2007 Gough ..... B61D 15/06 105/392.5
2008/0236440 A1 * 10/2008 Nakamura ..... B61D 15/06 105/392.5
2009/0065462 A1 * 3/2009 Gansweidt ..... B61G 7/10 213/1 A
2010/0064931 A1 * 3/2010 Heinisch ..... B61C 17/04 105/392.5
2011/0162555 A1 * 7/2011 Hayashi ..... B61D 15/06 105/392.5
2012/0205175 A1 * 8/2012 Masserang ..... B62D 65/18 180/220
2012/0325108 A1 * 12/2012 Graf ..... B61F 1/10 105/392.5
2013/0098264 A1 * 4/2013 Kuroda ..... B61D 15/06 105/392.5
2013/0104770 A1 * 5/2013 Nakao ..... B61D 15/06 105/392.5
2013/0125782 A1 * 5/2013 Ishizuka ..... B61D 15/06 105/392.5
2013/0233200 A1 * 9/2013 Taguchi ..... B61D 15/06 105/392.5
2014/0290528 A1 * 10/2014 Fan ..... B61F 19/04 105/392.5
2015/0033978 A1 * 2/2015 Oohashi ..... B61D 17/06 105/1.1
2015/0040792 A1 * 2/2015 Oohashi ..... B61D 17/04 105/1.1
2015/0040793 A1 * 2/2015 Nakao ..... B61D 17/06 105/1.1
2015/0298712 A1 * 10/2015 Hirashima ..... B61D 15/06 105/413
2016/0001794 A1 * 1/2016 Gibney ..... B61F 1/14 105/418

FOREIGN PATENT DOCUMENTS

JP 2011-235731 A 11/2011
WO 2012/136514 A1 10/2012

* cited by examiner

RAILCAR

TECHNICAL FIELD

The present invention relates to a railcar including a carbody capable of protecting a passenger room from impacts.

BACKGROUND ART

PTL 1 proposes a railcar including a carbody structure capable of protecting a passenger room when high external force is applied to an end bodyshell. In the carbody structure, an end beam is provided at an end portion of a carbody underframe via a crushable zone, and the end bodyshell is joined to the end beam. A slide center sill is provided at the crushable zone so as to project from a middle portion of the end beam toward a bolster beam to which a bogie is attached. In a state where the slide center sill is guided by a guide center sill provided at the bolster beam, the slide center sill is joined to the guide center sill by a fuse member. One end portion of an impact absorbing member is attached to an end surface of the bolster beam (and the guide center sill), and the other end portion of the impact absorbing member faces the slide center sill (and the end beam). According to this carbody structure, when a load higher than a predetermined load acts on the end bodyshell, the fuse member breaks, and the slide center sill is guided by the guide center sill. Then, the end bodyshell moves toward a rear side of the carbody, and the load is absorbed by the impact absorbing member.

CITATION LIST

Patent Literature

PTL 1: Japanese Laid-Open Patent Application Publication No. 2011-235731

SUMMARY OF INVENTION

Technical Problem

However, in the carbody structure of PTL 1, a beam connected to tip end portions of side sills of the underframe and extending in a car width direction is divided at a car width direction middle portion thereof into two parts. The slide center sill extends through a divided portion between the two parts to drastically get into a carbody longitudinal direction inner region, and the impact absorbing member is arranged between the bolster beam and the slide center sill. In this case, when absorbing the impact, the slide center sill moves in a region of the underframe which corresponds to the passenger room, and the impact absorbing member provided at the bolster beam breaks. Therefore, deformation is easily applied to the passenger room.

An object of the present invention is to improve the performance of protecting the passenger room of the carbody.

Solution to Problem

A carbody of a railcar according to the present invention includes: an underframe; and an energy absorber provided at the underframe, wherein: the underframe includes a first end beam located at a car longitudinal direction end portion of the underframe to extend in a car width direction, a second end beam located at a car longitudinal direction inner side of the first end beam to extend in the car width direction, and a sliding center sill connecting the first end beam and the second end beam with each other; the sliding center sill includes a first beam member connected to the first end beam, a second beam member connected to the second end beam, and a coupling member coupling the first beam member to the second beam member; the coupling member breaks by application of an impact load higher than a predetermined load to allow the first beam member to slide relative to the second beam member; the energy absorber is provided at the underframe so as to absorb energy generated by the impact load transferred from the first end beam to the second end beam; and the sliding center sill and the energy absorber are arranged in a region located between the first end beam and the second end beam.

According to the above configuration, the sliding center sill connecting the first end beam and the second end beam with each other includes the first beam member connected to the first end beam and the second beam member connected to the second end beam, and the sliding center sill and the energy absorber are arranged in the region located between the first end beam and the second end beam. The sliding center sill and the energy absorber are located in the region between the first end beam and the second end beam, so that even when the first beam member slides relative to the second beam member, and the energy absorber breaks at the time of the absorption of the impact, the deformation is hardly applied to the passenger room. Especially, a vestibule, a toilet, and various devices are provided in the region located between the first end beam and the second end beam, so that influences on the passenger room by the impact can be reduced. Therefore, the performance of protecting the passenger room of the carbody can be improved.

Advantageous Effects of Invention

As is clear from the above explanation, the present invention can improve the performance of protecting the passenger room of the carbody.

DESCRIPTION OF EMBODIMENTS

Hereinafter, embodiments will be explained in reference to the drawings.

First Embodiment

Figure 1:
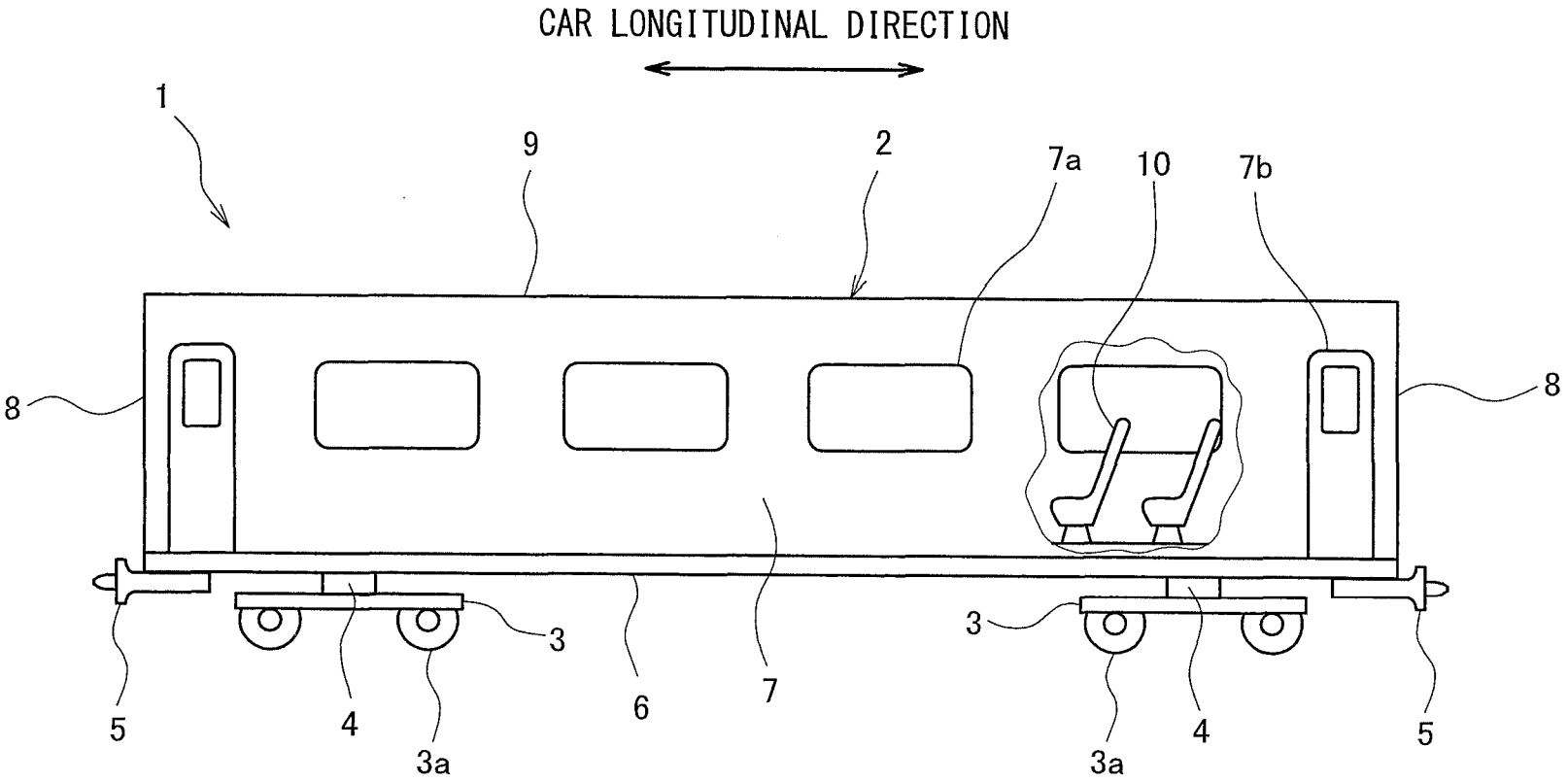
FIG. 1 is a side view showing a railcar according to a first embodiment.
Figure 2:
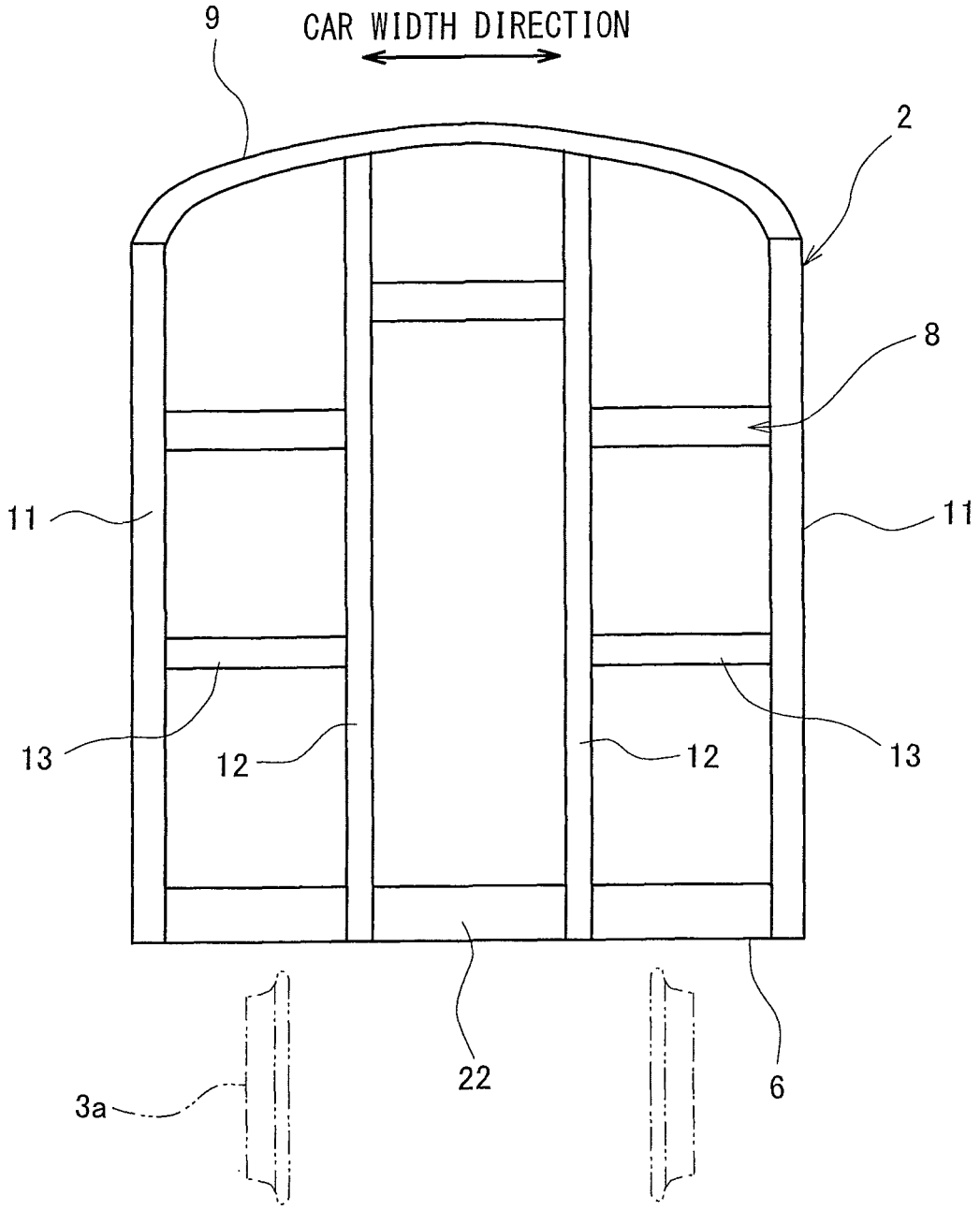
FIG. 2 is a front view showing a carbody of the railcar of FIG. 1.

FIG. 1 is a side view showing a railcar 1 according to the first embodiment. FIG. 2 is a front view showing a carbody 2 of the railcar 1 of FIG. 1. As shown in FIG. 1, the railcar 1 according to the first embodiment includes: the carbody 2 having a passenger room on which passengers get; and bogies 3 provided with wheels 3*a* and supporting the carbody 2 via bolster springs 4. The carbody 2 includes: an underframe 6 serving as a carbody bottom portion; side bodyshells 7 each having window opening portions 7*a*, door opening portions 7*b*, and a lower end portion connected to a car width direction side portion of the underframe 6; end bodyshells 8 each having a lower end portion connected to a car longitudinal direction end portion of the underframe 6; and a roof bodyshell 9 connected to upper end portions of the side bodyshells 7 and the end bodyshells 8. In the side bodyshell 7, each of the door opening portions 7*b* is located at a car longitudinal direction outer side of the bogie 3. Passenger seats 10 are arranged in an internal space of the carbody 10 so as to be located at a car longitudinal direction inner side of the door opening portions 7*b*. Couplers 5 each for coupling adjacent cars to each other are respectively provided at car longitudinal direction end portions of the underframe 6. The coupler 5 projects toward the car longitudinal direction outer side beyond the end bodyshell 8. As shown in FIG. 2, the end bodyshell 8 includes: a pair of corner posts 11 respectively located at both car width direction end portions of the end bodyshell 8 to extend in a vertical direction; a pair of end posts 12 located at a car width direction inner side of the corner posts 11 to extend from a first end beam 22 toward the roof bodyshell 9; and reinforcing beams 13 each connecting the corner post 11 and the end post 12 in a car width direction.

Figure 3:
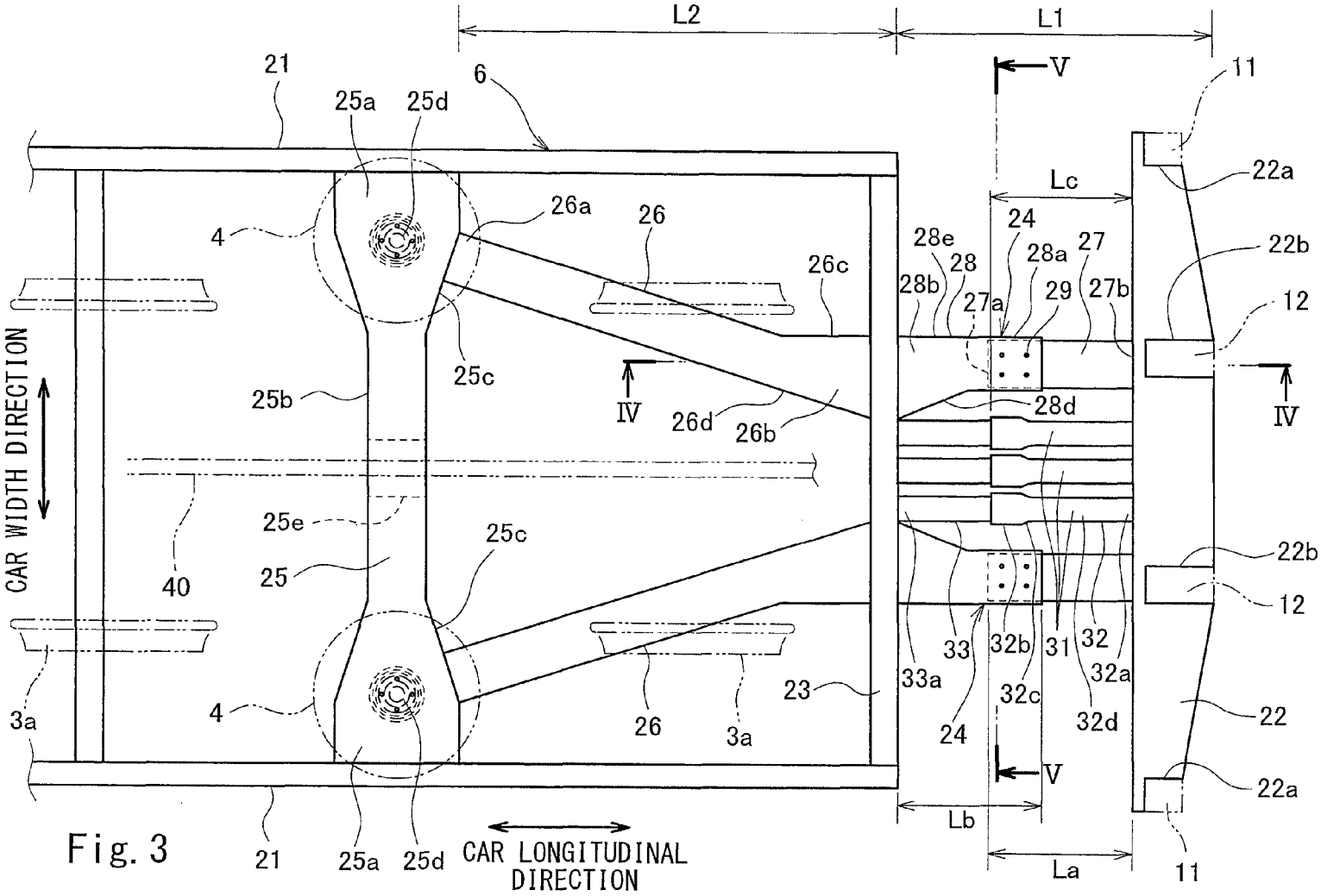
FIG. 3 is a plan view showing an underframe and energy absorbers of the carbody of the railcar of FIG. 1.
Figure 4:
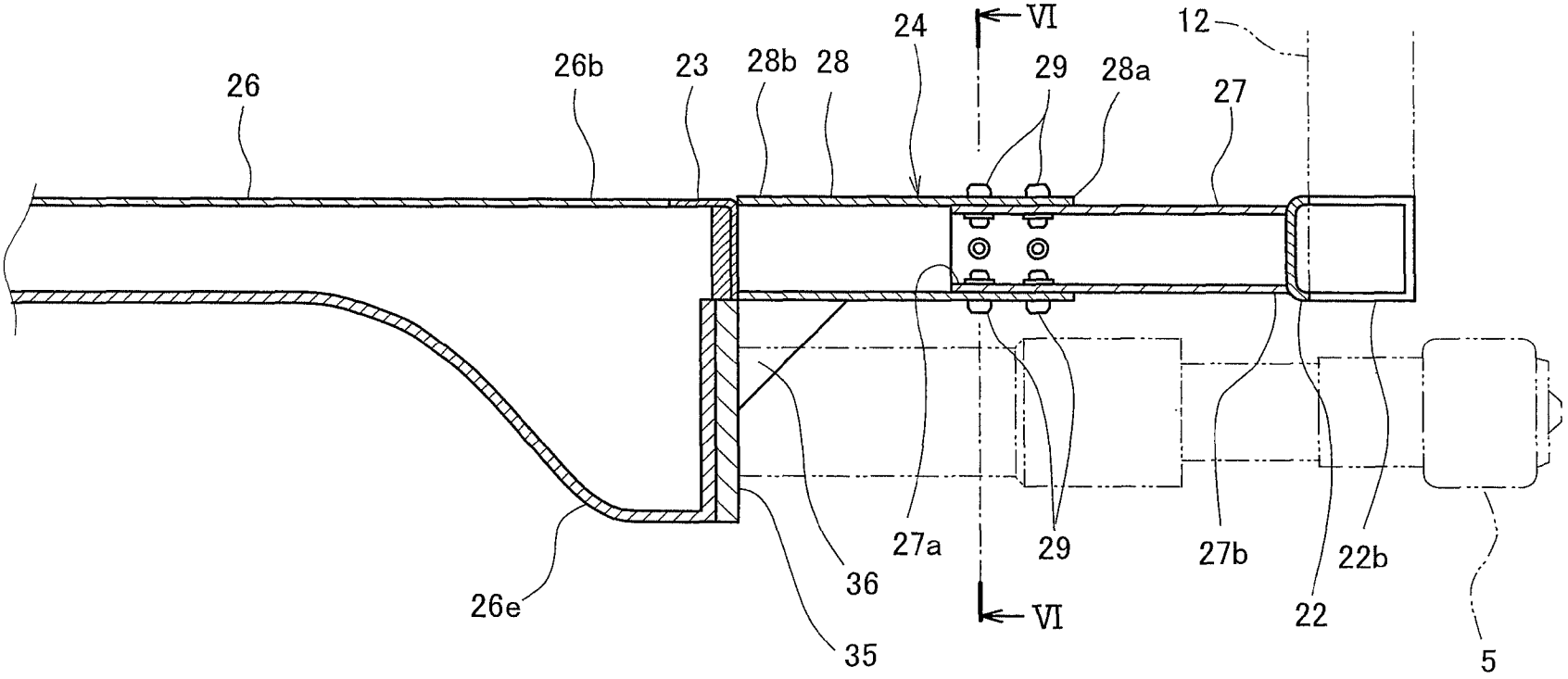
FIG. 4 is a cross-sectional view taken along line IV-IV of FIG. 3.
Figure 5:
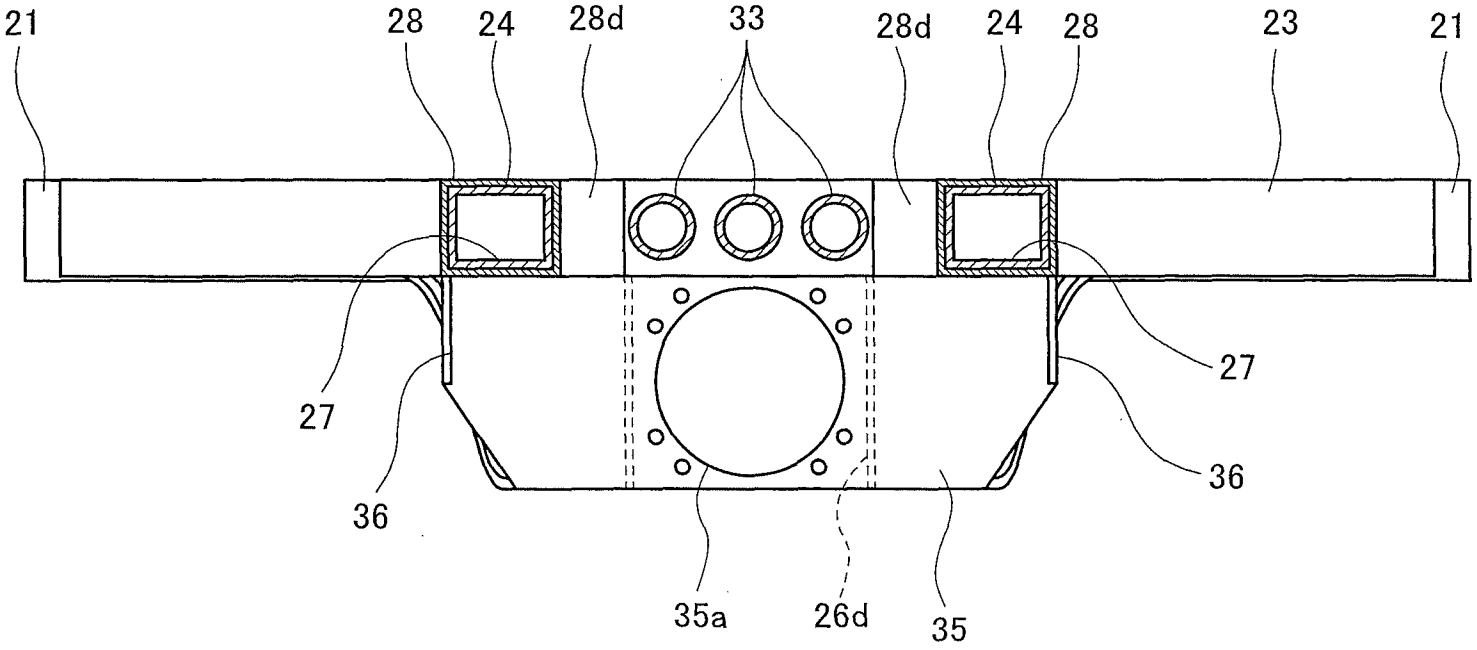
FIG. 5 is a cross-sectional view taken along line V-V of FIG. 3.
Figure 6:
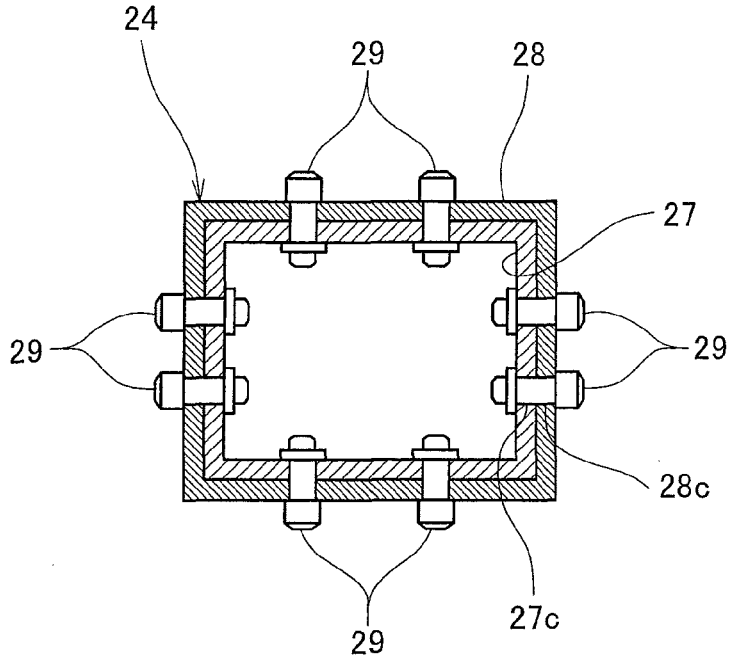
FIG. 6 is a cross-sectional view taken along line VI-VI of FIG. 4.
Figure 7:
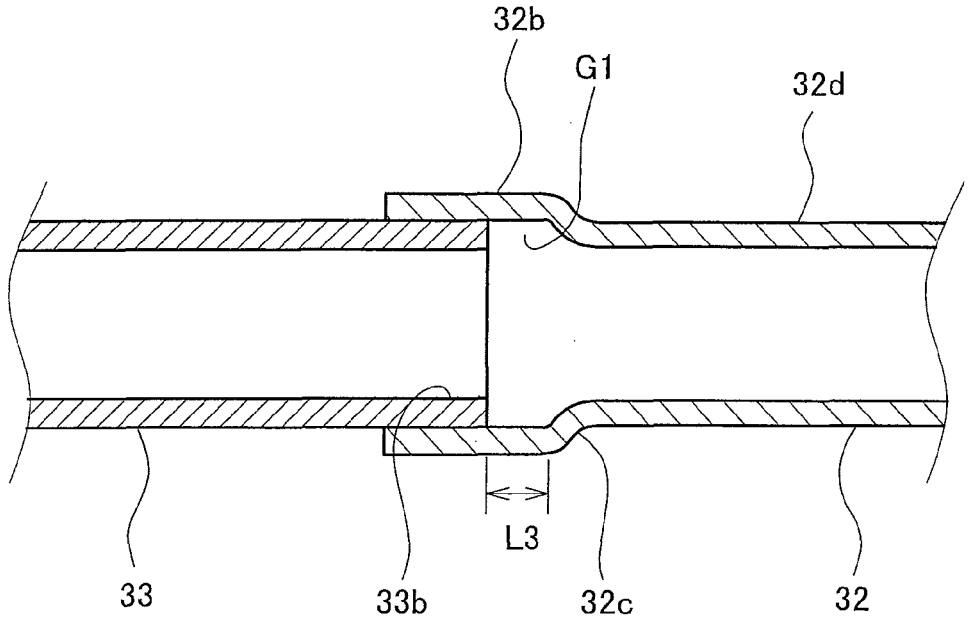
FIG. 7 is a cross-sectional view showing the energy absorber of FIG. 3.

FIG. 3 is a plan view showing the underframe 6 and energy absorbers 31 of the carbody 2 of the railcar 1 of FIG. 1. FIG. 4 is a cross-sectional view taken along line IV-IV of FIG. 3. FIG. 5 is a cross-sectional view taken along line V-V of FIG. 3. FIG. 6 is a cross-sectional view taken along line VI-VI of FIG. 4. FIG. 7 is a cross-sectional view showing the energy absorber 31 of FIG. 3. The following explanation is made in reference to mainly FIG. 3 and suitably FIGS. 4 to 7. As shown in FIG. 3, the underframe 6 is formed symmetrical about the car width direction. The underframe 6 includes: a pair of side sills 21 respectively located at both car width direction sides of the underframe 6 to extend in a car longitudinal direction; the first end beam 22 located at a car longitudinal direction end portion of the underframe 6 to extend in the car width direction; a second end beam 23 located at the car longitudinal direction inner side of the first end beam 22 to extend in the car width direction; and a pair of left and right sliding center sills 24 connecting the first end beam 22 and the second end beam 23 with each other.

The first end beam 22 is arranged away from longitudinal direction end portions of the side sills 21 toward the car longitudinal direction outer side. The first end beam 22 includes a pair of first cutout portions 22*a* for fixing the corner posts 11 and a pair of second cutout portions 22*b* for fixing the end posts 12. The first cutout portions 22*a* are respectively formed at both car width direction end portions of the first end beam 22 and are open toward the car longitudinal direction outer side and a car width direction outer side. The second cutout portions 22*b* are formed at the car width direction inner side of the first cutout portions 22*a* and are open toward the car longitudinal direction outer side. Lower end portions of the corner posts 11 are respectively fitted in the first cutout portions 22*a* to be connected to the first cutout portions 22*a* by welding or the like, and lower end portions of the end posts 12 are respectively fitted in the second cutout portions 22*b* to be connected to the second cutout portions 22*b* by welding or the like.

The second end beam 23 couples the longitudinal direction end portions of the side sills 21 to each other in the car width direction. The second end beam 23 extends linearly and continuously from one of the side sills 21 to the other. The second end beam 23 is arranged at the car longitudinal direction outer side of the wheels 3*a* located at the car longitudinal direction outer side of the bogie (see FIG. 1). A length L1 from a car longitudinal direction outer side end surface of the first end beam 22 to a car longitudinal direction outer side end surface of the second end beam 23 is shorter than a length L2 from the car longitudinal direction outer side end surface of the second end beam 23 to a car longitudinal direction outer side end surface of a bolster beam 25. In the internal space of the carbody 2 (see FIG. 1), the passenger seats are not arranged in a space immediately above a region located between the first end beam 22 and the second end beam 23. The passenger seats 10 (see FIG. 1) are arranged only in a space located at the car longitudinal direction inner side of the second end beam 23.

Each of the sliding center sills 24 includes: a first beam member 27 fixed to the first end beam 22 by welding or the like and having a length La in the car longitudinal direction; a second beam member 28 fixed to the second end beam 23 by welding or the like and having a length Lb in the car longitudinal direction; and coupling members 29 configured to couple the first beam member 27 to the second beam member 28. Each of the first beam members 27 and the second beam members 28 has a square tubular shape (see FIG. 6). An end portion 27*a* of the first beam member 27 and an end portion 28*a* of the second beam member 28 are opposed to each other and fitted to each other. At this fit portion, a plurality of holes 27*c* and 28*c* (see FIG. 6) are formed on the first beam member 27 and the second beam member 28. The first beam member 27 is fastened to the second beam member 28 such that the coupling members 29 (such as rivets, bolts, or screws) are inserted through the holes 27*c* and 28*c* communicating with each other. The strengths of the coupling members 29 are set such that when an impact load higher than a predetermined load acts on the first end beam 22 toward the car longitudinal direction inner side, the coupling members 29 break by the impact load.

A car longitudinal direction outer side end portion 27*b* of the first beam member 27 is fixed to the first end beam 22 by welding or the like. At least one of surfaces of side walls of the end portion 27*b* fixed to the first end beam 22 is substantially flush with a surface, extending in the car longitudinal direction, of the end post 12. To be specific, the sliding center sills 24 directly receive the impact load acting on the end posts 12 from a front side (right side in FIG. 3). A car longitudinal direction inner side end portion 28*b* of the second beam member 28 is fixed to the second end beam 23 by welding or the like. A car width direction inner side wall 28*d* of the end portion 28*b* of the second beam member 28 inclines obliquely toward the car width direction inner side such that the width of the second beam member 28 increases toward the second end beam 23. A car width direction outer side wall 28*e* of the end portion 28*b* of the second beam member 28 is formed linearly in the car longitudinal direction.

A plurality of energy absorbers 31 are arranged between a pair of sliding center sills 24 and between the first end beam 22 and the second end beam 23 so as to be parallel to one another. The energy absorbers 31 absorb energy generated by the impact load transferred from the first end beam 22 to the second end beam 23. In the present embodiment, three energy absorbers 31 are provided at predetermined intervals. Each of the energy absorbers 31 includes: a first pipe 32 having a car longitudinal direction outer side end portion 32*a* fixed to the first end beam 22 by welding or the like; and a second pipe 33 having a car longitudinal direction inner side end portion 33*a* fixed to the second end beam 23 by welding or the like. Each of the first pipes 32 and the second pipes 33 is a cylindrical tube whose axial direction coincides with the car longitudinal direction and has a length Lc in the longitudinal direction.

Each of the first pipes 32 includes a main body portion 32*d*, a large-diameter portion 32*b* and a step portion 32*c*. The main body portion 32*d* has a constant diameter. The large-diameter portion 32*b* is an end portion opposed to the second pipe 33. The large-diameter portion 32*b* has a constant diameter. The diameter of the large-diameter portion 32*b* is larger than the diameter of the main body portion 32*d*. The main body portion 32*d* is continuous with the large-diameter portion 32*b* by the step portion 32*c*. To be specific, the large-diameter portion 32*b* is an end portion of the first pipe 32 which is increased in diameter. The second pipe 33 is the same in diameter as the main body portion 32*d* of the first pipe 32 and includes an end portion 33*b* opposed to the first pipe 32, and the end portion 33*b* is fitted in the large-diameter portion 32*b* of the first pipe 32 (see FIG. 7). A gap G1 is formed between the end portion 33*b* of the second pipe 33 and the step portion 32*c* of the first pipe 32. A car longitudinal direction length L3 of the gap G1 is set to be larger than an outer diameter (car longitudinal direction size) of a portion of the coupling member 29, the portion being inserted in the hole 27*c* of the first beam member 27 and the hole 28*c* of the second beam member 28.

The underframe 6 includes: the bolster beam 25 to which the bogie 3 is attached via the bolster springs 4; and a pair of left and right nonsliding center sills 26 connecting the second end beam 23 to the bolster beam 25 so as not to be slidable. The nonsliding center sills 26 are arranged obliquely relative to the car longitudinal direction in a plan view, and a car width direction interval between the nonsliding center sills 26 increases from the second end beam 23 toward the bolster beam 25. The bolster beam 25 includes: attaching portions 25*a* respectively provided at both car width direction end portions of the bolster beam 25 and respectively attached onto the bolster springs 4; and a coupling portion 25*b* extending in the car width direction so as to couple the attaching portions 25*a* to each other. The width of each of the attaching portions 25*a* is larger than that of the coupling portion 25*b* in the car width direction. A side surface 25*c* of the attaching portions 25*a* to which an end portion 26*a* of the nonsliding center sill 26 is fixed inclines relative to the car width direction, and a normal direction of the side surface 25*c* coincides with a direction in which the nonsliding center sill 26 extends.

At least one of surfaces of side walls of an end portion 28*b*, located at the second end beam 23 side, of the sliding center sill 24 is substantially flush with a surface of a side wall, located at the second end beam 23 side, of the nonsliding center sill 26. In the present embodiment, car width direction positions of both side walls of the end portion 28*b* of the sliding center sill 24 respectively coincide with car width direction positions of both side walls of an end portion 26*b* of the nonsliding center sill 26. A car width direction outer side wall 26*c* of the end portion 26*b* of the nonsliding center sill 26 inclines obliquely relative to an extending direction of the nonsliding center sill 26 such that the width of the nonsliding center sill 26 increases toward the second end beam 23. In the present embodiment, the car width direction outer side wall 26*c* of the end portion 26*b* of the nonsliding center sill 26 extends in the car longitudinal direction. A car width direction inner side wall 26*d* of the end portion 26*b* of the nonsliding center sill 26 is formed linearly in the extending direction of the nonsliding center sill 26.

As shown in FIGS. 4 and 5, a lower wall portion 26*e* of the car longitudinal direction outer side end portion 26*b* of the nonsliding center sill 26 is bent downward such that a vertical size of the nonsliding center sill 26 increases. An attachment plate 35 having an attaching portion 35*a* to which the coupler 5 is attached is fixed to the end portion 26*b* of the nonsliding center sill 26 so as to be located under the second end beam 23. To be specific, the coupler 5 is connected to not the first end beam 22 but the second end beam 23. The attachment plate 35 is laterally long so as to reach positions under the sliding center sills 24 in a front view. Each of triangular gusset plates 36 is fixed to a front surface of the attachment plate 35 and a lower surface of the sliding center sill 24 by welding or the like.

As shown in FIG. 3, a linear body 40 that is at least one of a wire and a pipe is provided at the underframe 6 along the car longitudinal direction so as to be located at a car width direction middle position of the underframe 6. The linear body 40 extends through a guide passage 25*e* of the bolster beam 25. In a plan view, the linear body 40 extends in the car longitudinal direction along the underframe 6 beyond the wheels 3*a*, located at the car longitudinal direction outer side of the bogie 3 (see FIG. 1), to the vicinity of the second end beam 23. Further, at the car longitudinal direction outer side of the vicinity of the second end beam 23, the linear body 40 is provided toward a terminal box or the like arranged at a car end portion while suitably changing its direction to a downward direction or a side direction.

Next, an impact absorbing operation of the railcar 1 according to the present embodiment will be explained. In a case where another railcar (hereinafter simply referred to as an "oncoming car") collides with the railcar 1 from the front side (right side in FIG. 3), the oncoming car first collides with the coupler 5 (see FIG. 1). At this time, since the coupler 5 is attached to the second end beam 23, the coupler 5 breaks without directly transferring the impact to the first end beam 22, the sliding center sills 24, and the energy absorbers 31. Next, the oncoming car collides with the end posts 12 and the first end beam 22, and the impact of this collision is transferred to the coupling members 29. The coupling members 29 break by the impact load equal to or higher than the predetermined load. At this time, when the coupling members 29 break, the coupling members 29 slightly absorb the applied impact load.

Since the predetermined gap G1 is formed between the end portion 33*b* of the second pipe 33 and the step portion 32*c* of the first pipe 32, the energy absorbers 31 are prevented from becoming resistance to the break of the coupling members 29. To be specific, the energy absorber 31 includes a dead zone (play) which allows the first end beam 22 to move toward the second end beam 23 until the coupling members 29 break. Since the coupling members 29 break, the first beam member 27 can slide relative to the second beam member 28. With this, the sliding center sills 24 contract in the car longitudinal direction, and the first end beam 22 approaches toward the second end beam 23 while maintaining a posture of the first end beam 22.

At this time, the energy absorbers 31 deform so as to be crushed between the first end beam 22 and the second end beam 23. Thus, the energy generated by the impact load is absorbed. Specifically, the first pipe 32 and the second pipe 33 are crushed in the axial direction, and in addition, the end portion 33*b* (see FIG. 7) of the second pipe 33 acts so as to push and expand the main body portion 32*d* of the first pipe 32 in the radial direction. With this, the energy is effectively absorbed. Even after the sliding center sills 24 slide and contract, and the energy absorbers 31 are crushed, the sliding center sills 24 and the energy absorbers 31 remain in the region located between the first end beam 22 and the second end beam 23.

According to the above explained configuration, the sliding center sills 24 and the energy absorbers 31 are arranged in the region located between the first end beam 22 and the second end beam 23. Even when the first beam members 27 slide relative to the second beam members 28, and the energy absorbers 31 break at the time of the absorption of the impact, the sliding center sills 24 and the energy absorbers 31 are not in a region located at the car longitudinal direction inner side of the second end beam 23 of the underframe 6. Therefore, the deformation is hardly applied to the passenger room. On this account, the performance of protecting the passenger room of the carbody 2 can be improved. Further, since the sliding center sills 24 and the energy absorbers 31 do not occupy the region located at the car longitudinal direction inner side of the second end beam 23 of the underframe 6, an installation workability of wires and the like (the linear body 40) in the underframe 6 improves, and the space of the passenger room is not reduced. Therefore, the performance of protecting the passenger room of the carbody 2 can be improved while improving the workability of the wires and the like and the space efficiency in the carbody 2.

Since the coupler 5 is attached to the second end beam 23, the impact load transferred to the coupler 5 can be prevented from being directly transferred to the sliding center sills 24 and the energy absorbers 31. Therefore, after the impact load from the front side is received by the coupler 5, it is received by the first end beam 22. Thus, the absorption of the impact can be performed in multiple steps. The load generated when normally coupling the coupler 5 to the coupler of another car is not directly transferred to the first end beam 22. Therefore, the coupling members 29 can be prevented from being fatigued by repeated application of stress.

Car width direction positions of the sliding center sills 24 respectively overlap with car width direction positions of the end posts 12. Therefore, the impact received by the end posts 12 from the front side can be smoothly transferred to the sliding center sills 24. Further, car width direction positions of the end portions 26*b*, located at the second end beam 23 side, of the nonsliding center sills 26 overlap with car width direction positions of the end portions 28*b*, located at the second end beam 23, of the sliding center sills 24. Therefore, the impact received by the sliding center sills 24 can be smoothly transferred to the nonsliding center sills 26.

The nonsliding center sills 26 are arranged obliquely relative to the car longitudinal direction in a plan view. The car longitudinal direction inner side end portions 26*a* of the nonsliding center sills 26 are respectively fixed to the wide attaching portions 25*a* respectively connected to the side sills 21. Therefore, the impact transferred to the nonsliding center sills 26 can be stably received by the bolster beam 25 and the like.

As shown in FIG. 3, in the present embodiment, the length La of the first beam member 27, the length Lb of the second beam member 28, and the length Lc of the energy absorber 31 are equal to one another. With this, a limited space between the first end beam 22 and the second end beam 23 can be maximally utilized while securing a necessary stroke of an impact absorbing element.

Second Embodiment

Figure 8:
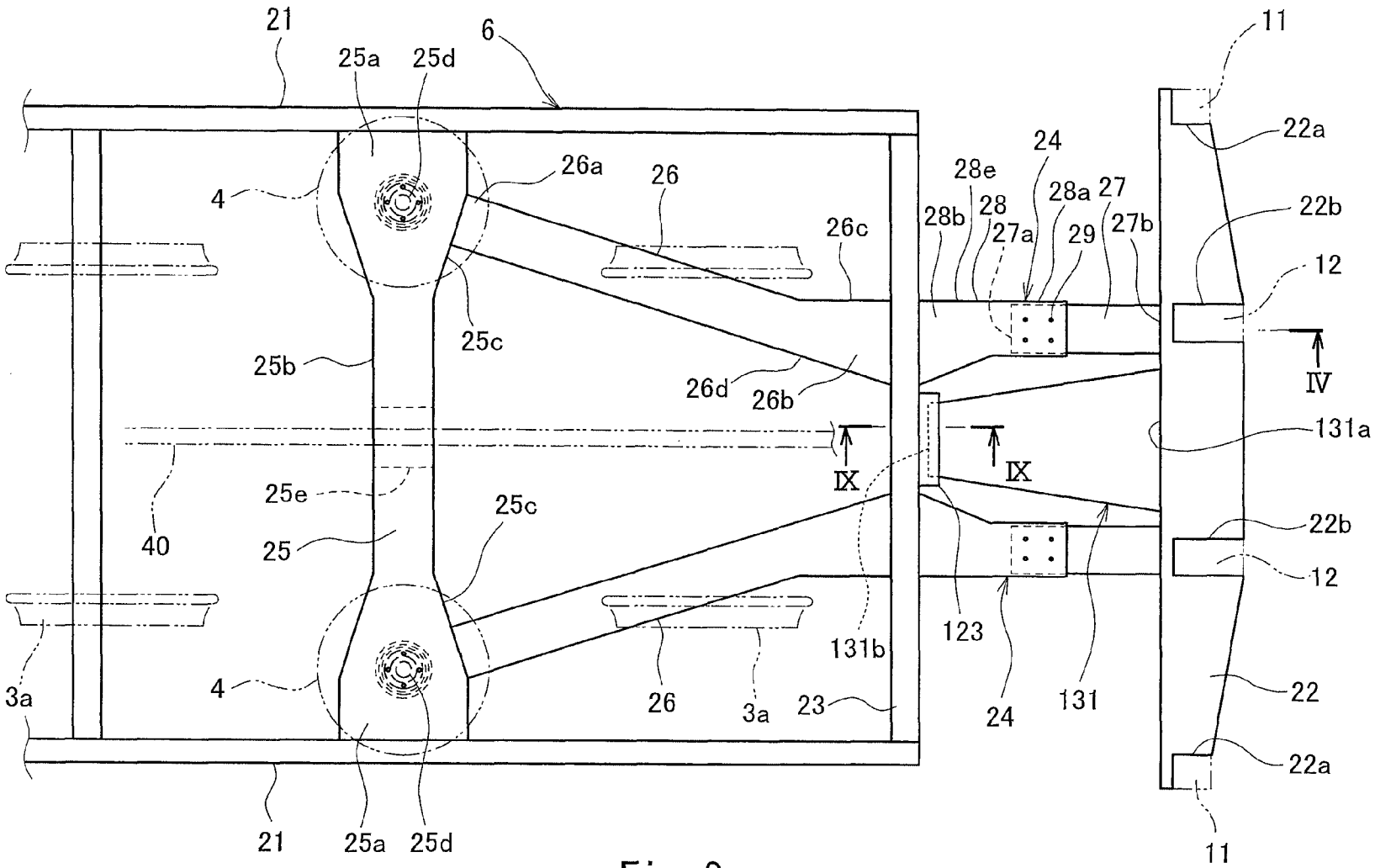
FIG. 8 is a diagram showing the railcar according to a second embodiment and corresponds to FIG. 3.
Figure 9:
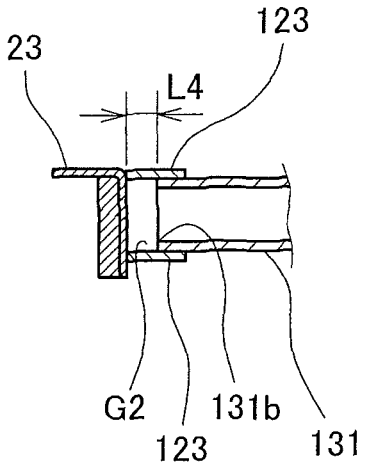
FIG. 9 is a cross-sectional view taken along line IX-IX of FIG. 8.

FIG. 8 is a diagram showing the railcar according to the second embodiment and corresponds to FIG. 3. FIG. 9 is a cross-sectional view taken along line IX-IX of FIG. 8. The same reference signs are used for the same components as in the first embodiment, and explanations thereof are omitted. As shown in FIGS. 8 and 9, the railcar according to the second embodiment includes an energy absorber 131 having a trapezoidal shape in a plan view. The energy absorber 131 is arranged between the sliding center sills 24 and between the first end beam 22 and the second end beam 23. The energy absorber 131 absorbs the energy generated by the impact load transferred from the first end beam 22 to the second end beam 23. The energy absorber 131 has a square tubular shape and also has a trapezoidal shape in a plan view. The width of the energy absorber 131 gradually decreases toward the car longitudinal direction inner side. The car width direction inner side wall of the end portion 28*b* of the second beam member 28 inclines obliquely toward the car width direction inner side such that the width of the second beam member 28 increases toward the second end beam 23. Therefore, by arranging a wide end portion 131*a* of the energy absorber 131 having the trapezoidal shape in a plan view at the first end beam 22 side, the energy absorber 131 can be arranged with a high space efficiency.

The wide end portion 131*a* located at the car longitudinal direction outer side is fixed to the first end beam 22 by welding or the like. A narrow end portion 131*b* of the energy absorber 131 at the car longitudinal direction inner side is slidably sandwiched between a pair of upper and lower guide plates 123 projecting from the second end beam 23 toward the car longitudinal direction outer side. The end portion 131*b* of the energy absorber 131 is spaced apart from the second end beam 23 by a predetermined gap G2. A car longitudinal direction length L4 of the gap G2 is set to be larger than the outer diameter (car longitudinal direction size) of the portion of the coupling member 29, the portion being inserted in the holes 27*c* and 28*c* of the first beam member 27 and the second beam member 28. By the existence of the gap G2, the energy absorber 131 is prevented from becoming resistance to the break of the coupling members 29. To be specific, the energy absorber 131 includes a dead zone (play) which allows the first end beam 22 to move toward the second end beam 23 until the coupling members 29 break.

The coupling members 29 break, and the first beam members 27 slide relative to the second beam members 28. With this, the end portion 131*b* of the energy absorber 131 hits against the second end beam 23, and the energy absorber 131 is sandwiched between the first end beam 22 and the second end beam 23 to be crushed. Thus, the energy is absorbed. At this time, since the upper and lower guide plates 123 are provided, the end portion 131*b* of the energy absorber 131 is prevented from being vertically displaced from the second end beam 23. Thus, the energy absorbing operation can be stably performed. In consideration of a reaction force property and the like, holes may be formed according to need on a plate constituting the energy absorber 131, or a partition wall may be provided in the square tube of the energy absorber 131.

The present invention is not limited to the above embodiments, and modifications, additions, and eliminations may be made within the scope of the present invention. For example, instead of the fastening members such as the rivets, welding materials may be used as the coupling members 29 of the sliding center sills 24. To be specific, the first beam member 27 and the second beam member 28 may be locally welded to each other such that when the impact load higher than the predetermined load acts, the welded portion breaks. The sliding center sills 24 and the energy absorbers 31 are directly fixed to the first end beam 22 and the second end beam 23. However, separate members may be interposed in the fixed portions. A member serving as an energy absorbing element as with the energy absorber 31 may be incorporated in the second beam member 28.

Further, the above embodiments have explained a case where the railcar 1 is applied as a middle car in a train set but may be applied as a front car. The nonsliding center sill 26 is arranged obliquely relative to the car longitudinal direction in a plan view. However, the nonsliding center sill 26 may be arranged to extend in a direction perpendicular to the second end beam 23 and the bolster beam 25.

INDUSTRIAL APPLICABILITY

As above, the railcar according to the present invention has an excellent effect of being able to suitably protect the passenger room from the impact. Thus, it is useful to widely apply the present invention to railcars which can achieve the significance of this effect.

REFERENCE SIGNS LIST

1 railcar
2 carbody
3 bogie
5 coupler
6 underframe
8 end bodyshell
12 end post
21 side sill
22 first end beam
23 second end beam
24 sliding center sill
25 bolster beam
26 nonsliding center sill
27 first beam member
28 second beam member
29 coupling member
31 energy absorber
32 first pipe
33 second pipe

The invention claimed is:

1. A railcar comprising:
an underframe including
a pair of side sills respectively located at both car width direction sides of the underframe, the pair of side sills extending in a car longitudinal direction,
a first end beam located at a car longitudinal direction end portion of the underframe, the first end beam extending in a car width direction,
a second end beam located at a car longitudinal direction inner side of the first end beam, the second end beam extending in the car width direction, the second end beam coupling longitudinal direction end portions of the side sills to each other in the car width direction, and
a sliding center sill connecting the first end beam and the second end beam with each other, the sliding center sill including
a first beam member connected to the first end beam,
a second beam member connected to the second end beam, and
a coupling member coupling the first beam member to the second beam member, the first beam member sliding relative to the second beam member when the coupling member breaks by application of an impact load higher than a predetermined load; and
an energy absorber provided at the underframe,
the sliding center sill and the energy absorber being arranged in a region located between the first end beam and the second end beam.

2. The railcar according to claim 1, further comprising an end bodyshell provided at a car longitudinal direction end portion of a carbody, wherein:
the first end beam is arranged away from the longitudinal direction end portions of the side sills toward a car longitudinal direction outer side; and
a lower end portion of the end bodyshell is connected to the first end beam.

3. The railcar according to claim 2, further comprising a coupler, wherein the coupler is attached to the second end beam.

4. The railcar according to claim 2, wherein at least one of surfaces of side walls of an end portion of the sliding center sill is substantially flush with a surface of an end post of the end bodyshell, the end portion of the sliding center sill being located at the first end beam side, the surface of the end post of the end bodyshell extending in the car longitudinal direction.

5. A railcar comprising:
an underframe including:
a first end beam located at a car longitudinal direction end portion of the underframe, the first end beam extending in a car Width direction,
a second end beam located at a car longitudinal direction inner side of the first end beam, the second end beam extending in the car width direction, and
a sliding center sill connecting the first end beam and the second end beam with each other, the sliding center sill including:
a first beam member connected to the first end beam,
a second beam member connected to the second end beam, and
a coupling member coupling the first beam member to the second beam member, the first beam member sliding relative to the second beam member, when the coupling member breaks by application of an impact load higher than a predetermined load; and
an energy absorber provided at the underframe,
the sliding center sill and the energy absorber being arranged in a region located between the first end beam and the second end beam,
the underframe including a bolster beam and a nonsliding center sill, a bogie being attached to the bolster beam, and the nonsliding center sill connecting the second end beam to the bolster beam; and
at least one of surfaces of side walls of an end portion of the sliding center sill being substantially flush with a surface of a side wall of the nonsliding center sill, the end portion of the sliding center sill being located at the second end beam side, the side wall of the nonsliding center sill being located at the second end beam.

6. The railcar according to claim 5, wherein:

the nonsliding center sill comprises a pair of nonsliding center sills arranged in the car width direction; and the nonsliding center sills are arranged obliquely relative to a car longitudinal direction in a plan view such that an interval between the nonsliding center sills in the car width direction increases from the second end beam toward the bolster beam.

7. A railcar comprising:

an underframe including:

a first end beam located at a car longitudinal direction end portion of the underframe, the first end beam extending in a car width direction, a second end beam located at a car longitudinal direction inner side of the first end beam, the second end beam extending in the car width direction, and a sliding center sill connecting the first end beam and the second end beam with each other, the sliding center sill including:

a first beam member connected to the first end beam, a second beam member connected to the second end beam, and a coupling member coupling the first beam member to the second beam member, the first beam member sliding relative to the second beam member when the coupling member break by application of an impact load higher than a predetermined load; and an energy absorber provided at the underframe, the sliding center sill and the energy absorber being arranged in a region located. between the first end beam and the second end beam, the energy absorber including:

a first pipe connected to the first end beam and a second pipe connected to the second end beam;

a diameter of an end portion of one of the first pipe and the second pipe being larger than a diameter of an end portion of the other of the first pipe and the second pipe, the diameter of the end portion of the one of the first pipe and the second pipe being fitted in the end portion of the other of the first pipe and the second pipe;

the sliding center sill comprising a pair of sliding center sills arranged in the car width direction; and the energy absorber being arranged between the sliding center sills.

8. The railcar according to claim 7, wherein:

the one of the first pipe and the second pipe includes a main body and a step portion;

the main body portion is configured to continue with the end portion of the one of the first pipe and the second pipe by the step portion; and the energy absorber has a gap provided between the step portion and the end portion of the other of the first pipe and the second pipe.

* * * * *